US006170826B1

(12) United States Patent
Jones

(10) Patent No.: US 6,170,826 B1
(45) Date of Patent: Jan. 9, 2001

(54) THREE PERSON CHESS GAME AND METHOD OF PLAY

(76) Inventor: Jeffrey A. Jones, 2836 Sterling Rd., Bay #J, Hollywood, FL (US) 33020

( * ) Notice: Under 35 U.S.C. 154(b), the term of this patent shall be extended for 0 days.

(21) Appl. No.: 09/263,932

(22) Filed: Mar. 8, 1999

(51) Int. Cl.[7] ..... A63F 3/02
(52) U.S. Cl. ..... 273/261; D21/348
(58) Field of Search ..... 273/261, 260; D21/348

(56) References Cited

U.S. PATENT DOCUMENTS

| | | | | |
|---|---|---|---|---|
| D. 348,082 | * | 6/1994 | Seabury | D21/348 |
| 3,533,627 | | 10/1970 | Deffenbauch et al. | 273/261 |
| 3,652,091 | | 3/1972 | Zubrin | 273/261 |
| 3,744,797 | | 7/1973 | Hopkins | 273/261 |
| 3,778,065 | | 12/1973 | Hale | 273/261 |
| 3,836,149 | | 9/1974 | Adams | 273/261 |
| 3,920,247 | | 11/1975 | Jenkins | 273/261 |
| 3,963,242 | | 6/1976 | Treugut et al. | 273/261 |
| 3,964,747 | | 6/1976 | Balmforth | 273/261 |
| 3,998,464 | | 12/1976 | Poturalski | 273/261 |
| 4,229,008 | | 10/1980 | Jameson | 273/261 |
| 4,580,787 | | 4/1986 | Baker | 273/261 |
| 4,940,241 | | 7/1990 | Faraci, Jr. | 273/261 |
| 5,158,302 | | 10/1992 | Rewega | 273/261 |
| 5,209,488 | | 5/1993 | Kimball | 273/261 |
| 5,421,582 | | 6/1995 | Ritter | 273/261 |
| 5,582,410 | | 12/1996 | Hunt | 273/261 |
| 6,070,871 | * | 6/2000 | Wilson et al. | 273/261 |

FOREIGN PATENT DOCUMENTS

| | | | | |
|---|---|---|---|---|
| 2702669 | * | 9/1994 | (FR) | 273/261 |
| 2033239 | * | 5/1980 | (GB) | 273/261 |

* cited by examiner

*Primary Examiner*—Benjamin H. Layno
(74) *Attorney, Agent, or Firm*—Tom Hamill Jr.

(57) ABSTRACT

A novel three person chess apparatus and method of play is disclosed. A generally hexagonal board is provided having alternating side lengths of 8 and 9 spaces. Each of the three sides in the game set up the rear rank of their pieces on one of the 9 spaced sides. A new piece, referred to in the preferred embodiment as the "Champion", is located centrally on the rear rank, between the King and the Queen, and combines the moves of either the Bishop or Knight. The rest of the major pieces are placed in the customary positions. 10 pawns are placed in the rank immediately in front of these major pieces and play alternates in a sequential fashion between the three players until two of the Kings are checkmated or a stalemate occurs. Once a King of one of the players is checkmated, the King is removed from the board, is replaced by the capturing player with any captured piece, and play continues, with the remaining pieces of the captured King immobilized, serving as blocking or shielding obstacles that, however, may be captured at will by either of the remaining players for positional advantage. This game may be adapted to be played by two or three players. This game may be further be adapted to be played in an electronic format, either as a stand alone device, or on a computer. Further, this game may be adapted to be played over the Internet or on other computer networks.

14 Claims, 9 Drawing Sheets

WHITE

WHITE

LEFT KNIGHT SHOWING POSSIBLE MOVES USING (2 AND 1) SPACE MOVE.

CENTER KNIGHT SHOWING ALL POSSIBLE MOVES.

RIGHT KNIGHT SHOWING POSSIBLE MOVES USING (1 AND 2) SPACE MOVE.

X
X
X

THREE PERSON CHESS GAME AND METHOD OF PLAY

BACKGROUND OF THE INVENTION

1. Field of the Invention

The present invention relates to games and amusement devices. The chess game relates to a three person chess game having a unique board shape and configuration. It further relates to a three player chess game wherein the original rules of two person chess are more closely mimicked, leading to a game that is easily learned by players of traditional chess. Additionally, it relates to a three person chess game where the board configuration is such that the setting up of the various player's pieces is easily accomplished. The game also relates to a three person chess game wherein a new piece, allowing the user to move it as either a Bishop or a Knight, is introduced. The game may be played with two or three players. In a two man game, the pieces on the unused side of the board may be present or may be completely omitted. A three player game will be reduced to a two player game due to the course of play.

2. Description of the Prior Art

One of the drawbacks of traditional chess is in that only two players at a time can participate. A three player game, it is thought, would provide an extra element of strategy and human interaction in the play of the game. Temporary alliances could be formed and broken during the course of play, which could lead to added excitement and enjoyment of the process. The present invention seeks to accomplish this by providing an easily learned game that allows three players to simultaneously compete within a modified chess framework. Three person chess games are known in the prior art yet many of them have drawbacks in that the setup of the pieces on the board can be confusing, the play of the pieces can be difficult to remember, and the strategies typically used in conventional chess are of little or no value within the context of the novel board set and rules of the modified game. The present invention seeks to address these problems by providing a three-person chess game that obviates any difficulty in the placement of the pieces on the board, provides rules that conform generally to standard chess as it is played, and allows the user to utilize familiar, two person chess strategies in playing the game described by the instant invention. In the course of a search at the U.S. Patent and Trademark Office, a number of patents were uncovered, and they are discussed hereinbelow:

In U.S. Pat. No. 3,836,149 issued on Sep. 17, 1974, to Kevin L. Adams et al. there is disclosed a three man chess game apparatus. This apparatus is clearly dissimilar from the present invention in that the playing surface has a generally triangular shape and that the rear rank of the playing pieces is recessed from the main body of the board.

U.S. Pat. No. 3,920,247 issued to Daniel T. Jenkins on Nov. 18, 1975 discloses a chess game apparatus that is described as being adapted for two or three players. Unlike the present invention, the sides of the generally hexagonal board have equal numbers of spaces along each side, whereas the instant invention alternates the number hexes on the sides of the board to allow for simpler setup and game play.

In U.S. Pat. No. 3,652,091 issued on Mar. 28, 1972 to Robert Zubrin, there is disclosed a three player chess board. This board is divided into three territories for simultaneous play by three players. Unlike the present invention, there is no teaching of the alternating number of hexes on succeeding sides of the board.

Another patent of interest is U.S. Pat. No. 3,963,242 issued on Jun. 15, 1976 to Andrea Treuget et al. This discloses a chess game for three people on a hexagonal board, but the playing "squares," unlike the present invention, are seen to be triangular and do not extend along the lengths of all sides of the board, as is seen in the present invention.

Next is U.S. Pat. No. 5,209,488 issued to Mark R. Kimball on May 11, 1993. This is a three player chess-like game with three generally square areas connected by an equilateral triangle in the center. This board is clearly dissimilar from the board of the present invention.

Another patent of interest is U.S. Pat. No. 5,421,582 issued on Jun. 6, 1995 to Carl E. Ritter. This discloses an expanded chess game and method using an octagonally shaped board. Unlike the present invention, there is no teaching of the hexagonal playing spaces or of the three types of indicia on the board to assist the players in properly setting up the pieces.

U.S. Pat. No. 3,533,627 issued on Oct. 13, 1970 to Gene Deffenbraugh et al. discloses a three player chess game board. Unlike the present invention, the board does not show the unique alternating eight and nine sided hexagonal playing spaces essential to the three person game of the instant invention.

In U.S. Pat. No. 4,940,241 issued on Jul. 10, 1990 to John A. Faraci, Jr. there is disclosed a three player chess-type game. The board is generally shaped as an equilateral triangle and does not have the hexagonal playing spaced of the instant invention.

In U.S. Pat. No. 4,229,008 issued on Oct. 21, 1980 to Michael J. Jameson there is disclosed an apparatus for playing a game. Unlike the present invention, there are no hexagonal playing spaces shown, and the six sides of the board have equal numbers of playing spaces disposed thereon.

Another patent of interest is U.S. Pat. No. 5,582,410 issued to Aaron A. Hunt on Dec. 10, 1996. This discloses a multiplayer chess game played on a hexagonal board with hexagonal playing spaces. As in many of the patents discussed above, the number of spaces along each side of the board is equal. In the present invention, the sides alternate in length from eight to nine spaces along the periphery. This allows for a game more similar in geometry to the traditional game of chess.

U.S. Pat. No. 3,964,747 issued on Jun. 22, 1976 to Ernest Lynn Balmforth discloses a game apparatus. As in many of the patents above, the lengths of all sides of the hexagonal board are equal. As will be described below, the novel apparatus of the present invention, with the alternate length sides on a hexagonal board, provides for an improved traditional game geometry more familiar to players.

U.S. Pat. No. 3,778,065 issued to Norman L. Hale on Dec. 11, 1973 discloses a three player chess game apparatus. Unlike the present invention, the numbers of playing hexes on the sides of the board alternate between eight and six, instead of eight and nine. Moreover, the playing pieces in their starting positions are arrayed upon the eight hex sides, as opposed to the nine hex sides in the instant invention. This makes a large difference in the geometry of play, and serves to differentiate Hale from the present invention.

U.S. Pat. No. 3,744,797 issued to Mark Alan Hopkins on Jul. 10, 1973 discloses a chess game apparatus. The lengths of the sides in this apparatus are five and 10, respectively. This, as has been discussed above in relation to other patents, makes the device dissimilar from the present invention.

Lastly, U.S. Pat. No. 5,158,302 issued on Oct. 27, 1992 to Dana R. Rewega discloses a three player chess game. This apparatus has four and eight alternating playing spaces on a side. Thus it is felt that it is clearly unlike the present invention and the novel game geometry that the instant apparatus allows for.

None of the above inventions and patents, taken either singly or in combination, is seen to describe the instant invention as claimed.

SUMMARY OF THE INVENTION

The present invention is a novel three person chess apparatus and method of play. A generally hexagonal board is provided having alternating side lengths of eight and nine spaces. Each of the three sides in the game set up the rear rank of their pieces on one of the nine spaced sides. A new piece, referred to in the preferred embodiment as the "Champion," is located centrally on the rear rank, between the King and the Queen, and allows the move of either the Bishop or Knight. The rest of the major pieces are placed in the customary positions. Ten pawns are placed in the rank immediately in front of these major pieces and play alternates in a sequential fashion among the three players until two of the Kings are checkmated or a stalemate occurs. Once a King of one of the players is checkmated, the King is removed from the board, is replaced by the capturing piece, and play continues, with the remaining pieces of the captured King immobilized, serving as blocking or shielding obstacles that, however, may be captured at will by either of the remaining players for positional advantage. The player with the checkmated king has lost the game, and is considered out of the game.

Accordingly, it is the primary object of the invention to provide a three person chess game that allows for more traditional type chess strategy to be used than is seen in the prior art.

Another object of the invention is to provide a three person chess game where the structure of the board is such that each player is aware of the side that their pieces are initially placed by virtue of the corresponding indicia or color of the right rear rank hex as in traditional chess.

Yet another object of the invention is to provide an improved three person chess game where, because of the three players involved, pawns may move and capture in any direction on the board.

Still yet another object of the invention is to provide an improved three person chess game wherein a new major piece, centrally located between the King and Queen on the nine space rear rank may be moved either as a Bishop or a Knight.

An additional object of the invention is to minimize complexity and cost of fabrication.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
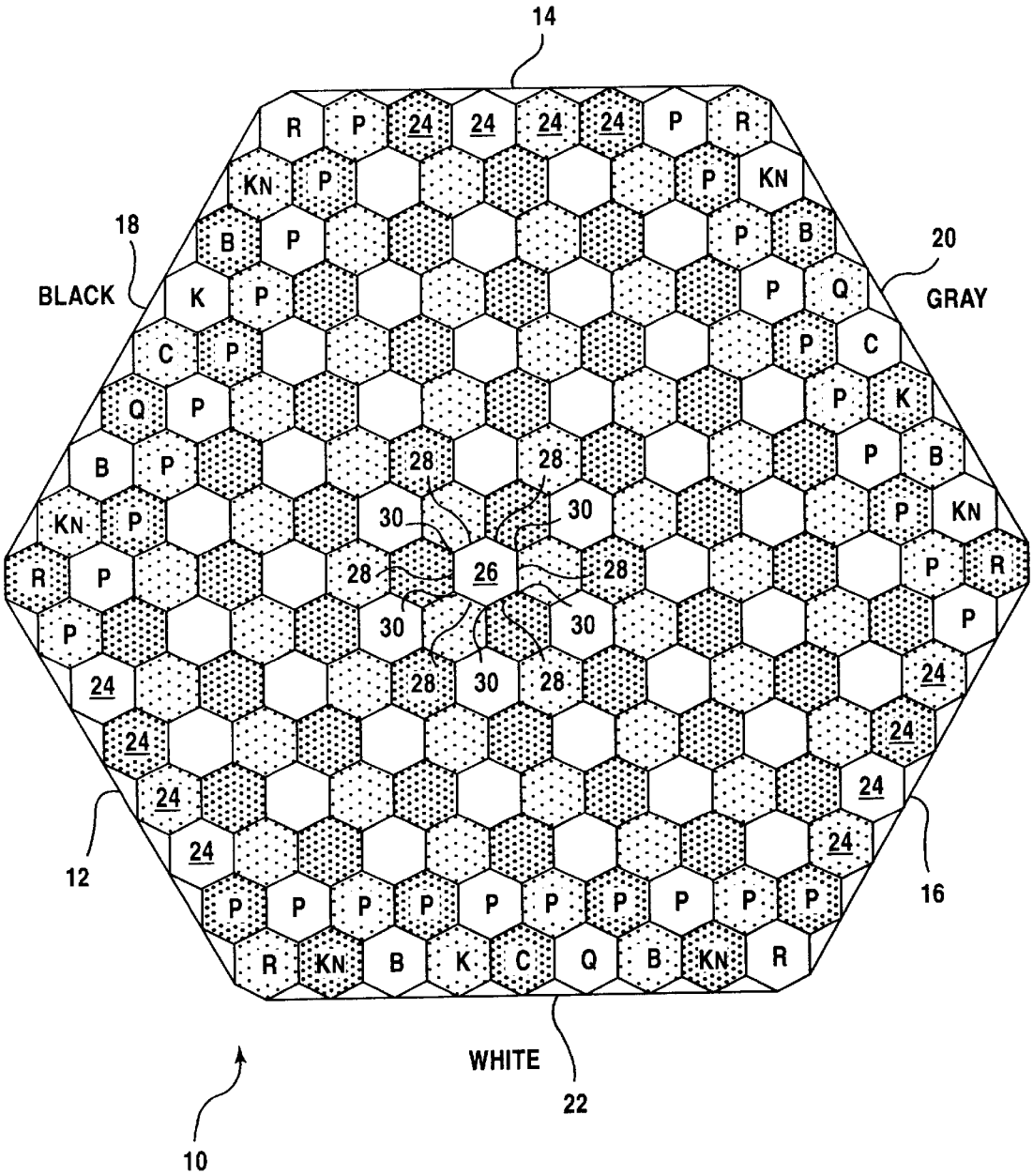
FIG. 1 is a top plan view of the novel three person chessboard of the present invention showing the hex spaces preferred color scheme and the initial setup of the pieces prior to play.

Referring first to FIG. 1, the overall configuration of the board 10 will be discussed. In the preferred embodiment, the board consists of a generally hexagonal board having 192 hexagons marked thereon. These hexagons are of three different colors or are marked with three different types of indicia such that no two adjacent spaces are the same. The length of the sides alternate between eight and nine hexes, equal lengths disposed opposite one another. The eight spaced sides are marked 12, 14, and 16. The nine spaced sides are indicated at 18, 20, and 22. Note that these sides 18, 20, and 22 are the sides that the players initially dispose the starting pieces. It should be understood that the invention should not be limited to hexagonal playing spaces. Other shapes could be adapted by the skilled practitioner to achieve the same results. Octagons, marked circles, or any variety of polygon, properly marked, could be used. It should be emphasized at the outset that the alternate sides of eight and nine spaces are important to the game play geometry as this leaves four empty hexes between the three closest corners of the setup gameboard, as indicated at 24. Note that this is the same number of spaces between pawns at the outset of a traditional, two person game, and that this allows for traditional types of strategies (with some modification) to be used. It should additionally be commented on that any confusion in the matter of setting up the board is obviated by the right rear rank hex of each side being the same color as the side to be placed on that rank. The Rooks, Knights, and Bishops are placed in their customary position. The side's Queen is placed next to the Bishop on her own color, the King is placed next to the opposite Bishop, and the Champion is placed centrally between them. Ten pawns are then placed on the rank immediately in front of these major pieces. In the embodiment described here, it is contemplated that the three sides are labeled White, Gray, and Black. It is also contemplated that White would move first, and that play would proceed clockwise around the board. Other names for the various sides could of course be used, and play order could be determined through any number of methods.

The discussion now turns to the piece movements on the playing board. In the embodiment described herein, the playing spaces are hexagons. An example of one of these hexagonal playing spaces is enumerated at 26 in FIG. 1. Each of the hexagons have flat sides, indicated at 28 in the example hexagon in FIG. 1 and angled sides, indicated at 30 in FIG. 1. The pieces, as described below, move across varying numbers of these sides according to type, interference by other pieces, and the player's intent.

Rooks

Figure 2:
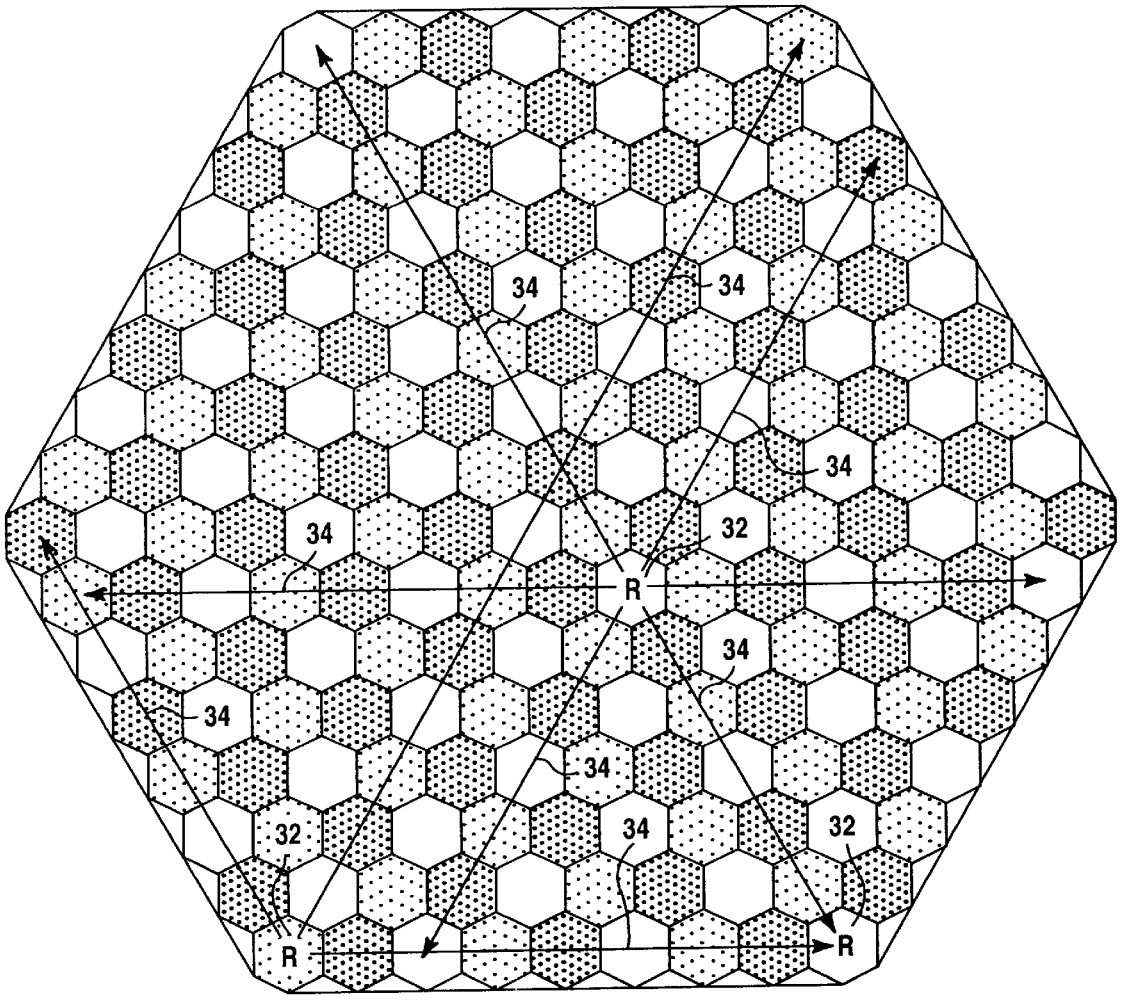
FIG. 2 is a top plan view of the chessboard showing the manner in which the Rooks are moved across the flat sides of the hexes in the game.

In FIG. 2, the movement of the Rooks is shown. They may move, limited by the interference of other pieces on the board, across any number of flat hex sides as the player wishes. The direction of movement of the example rooks 32 are indicated by directional arrows 34.

Bishops

Figure 3:
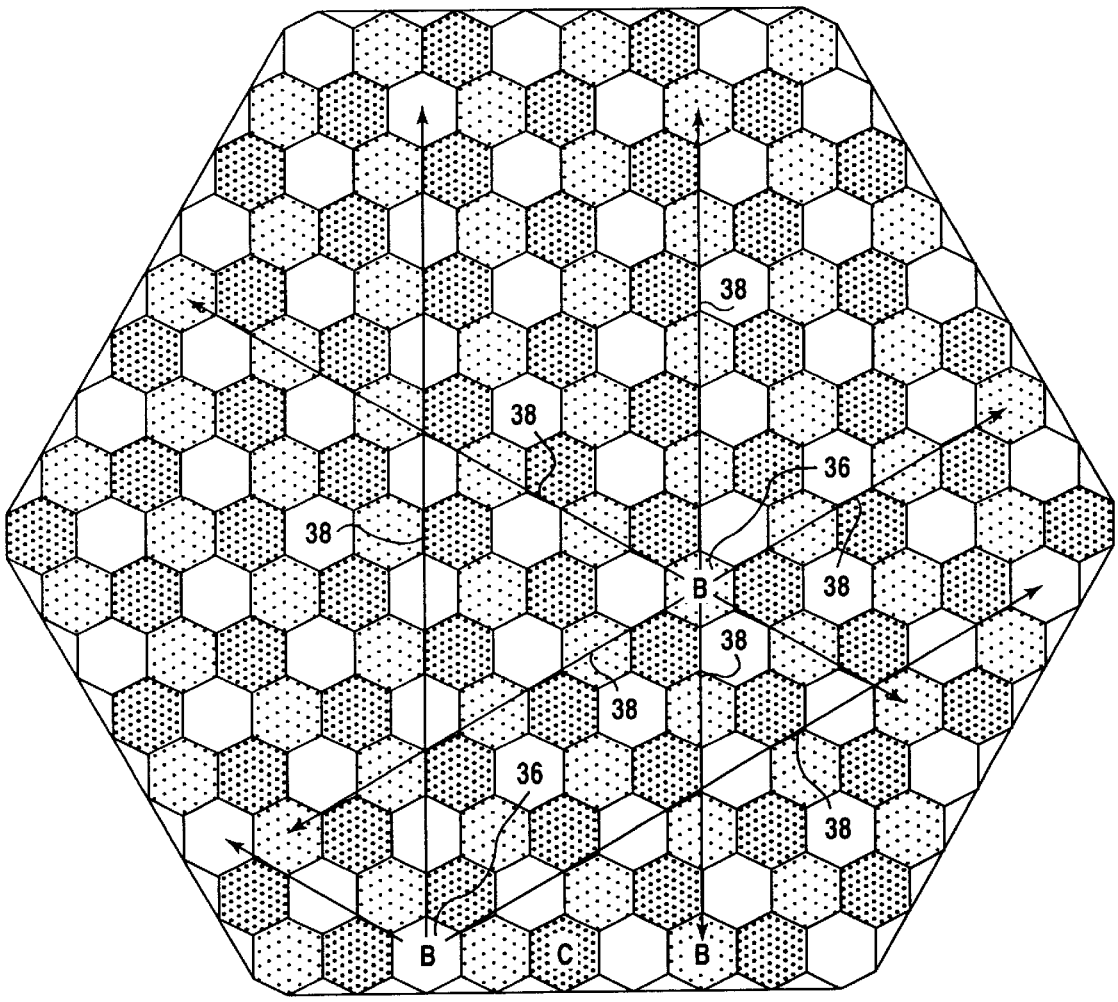
FIG. 3 is a top plan view of the chessboard showing the manner in which the Bishops are moved through the angled sides of the hexes, limiting them, as in normal chess, to spaces of their original starting color.

In FIG. 3, the movement of the Bishops 36 is shown. These pieces are also subject to blockage by friendly or opposing pieces and they travel across the angled hex sides in a diagonal manner indicated by arrows 38. Thus, as in traditional chess, the two bishops of each side are limited to the colored hexes that they originally began on.

Knights

Figure 4:
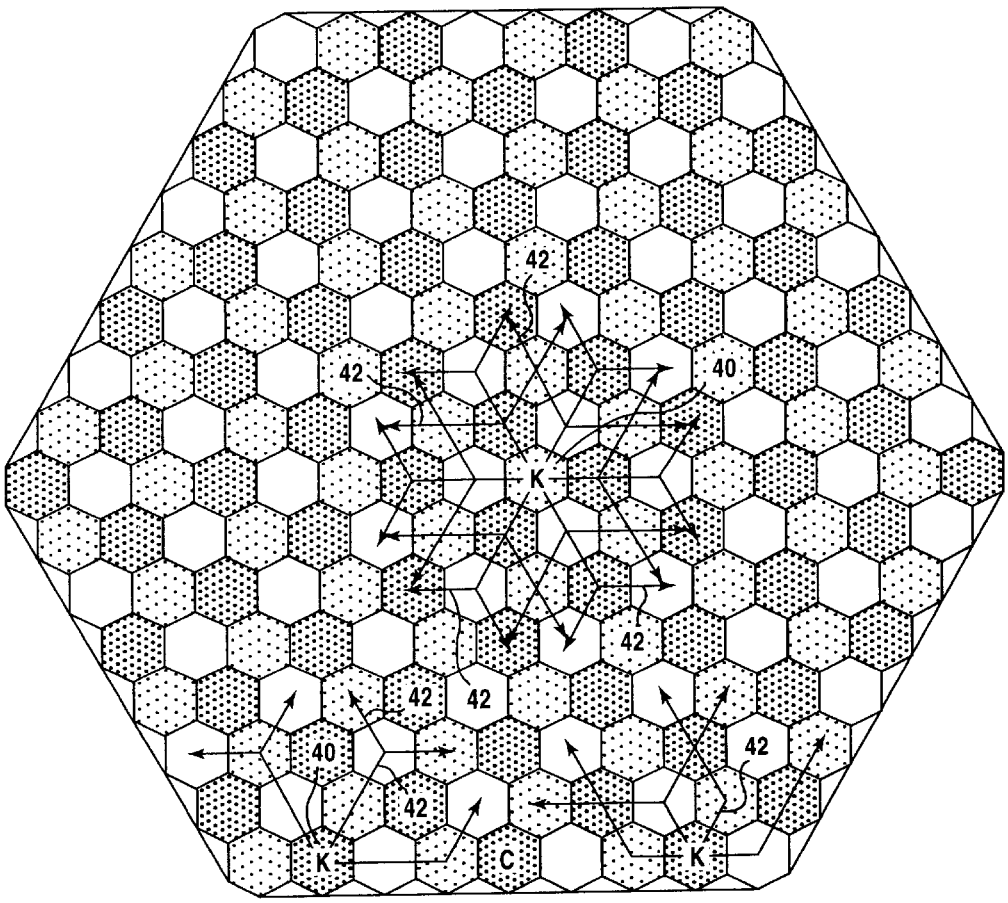
FIG. 4 is a top plan view of the chessboard showing the manner in which the Knights are moved, either first one hex, then a forward 60° jog and two further hexes, or a two hex move, a forward 60° jog and one further hex, analogous to the Knight's move on a traditional board, including the ability to leap or move over interposing pieces on the board.

The Knight 40 moves are shown in FIG. 4. These moves are analogous to the Knight moves in traditional chess but the movement is across flat hex sides. A total of three flat hex sides may be crossed. After either the first or the second flat hex side is crossed in a single direction, a forward 60° turn through one flat hex side is made and the remaining two or one hex sides are then crossed. These possible moves are indicated by the arrows 42. As in traditional chess, the Knight is allowed to leap, or jump over, any friendly or unfriendly intervening pieces in its path.

King and Queen

Figure 5:
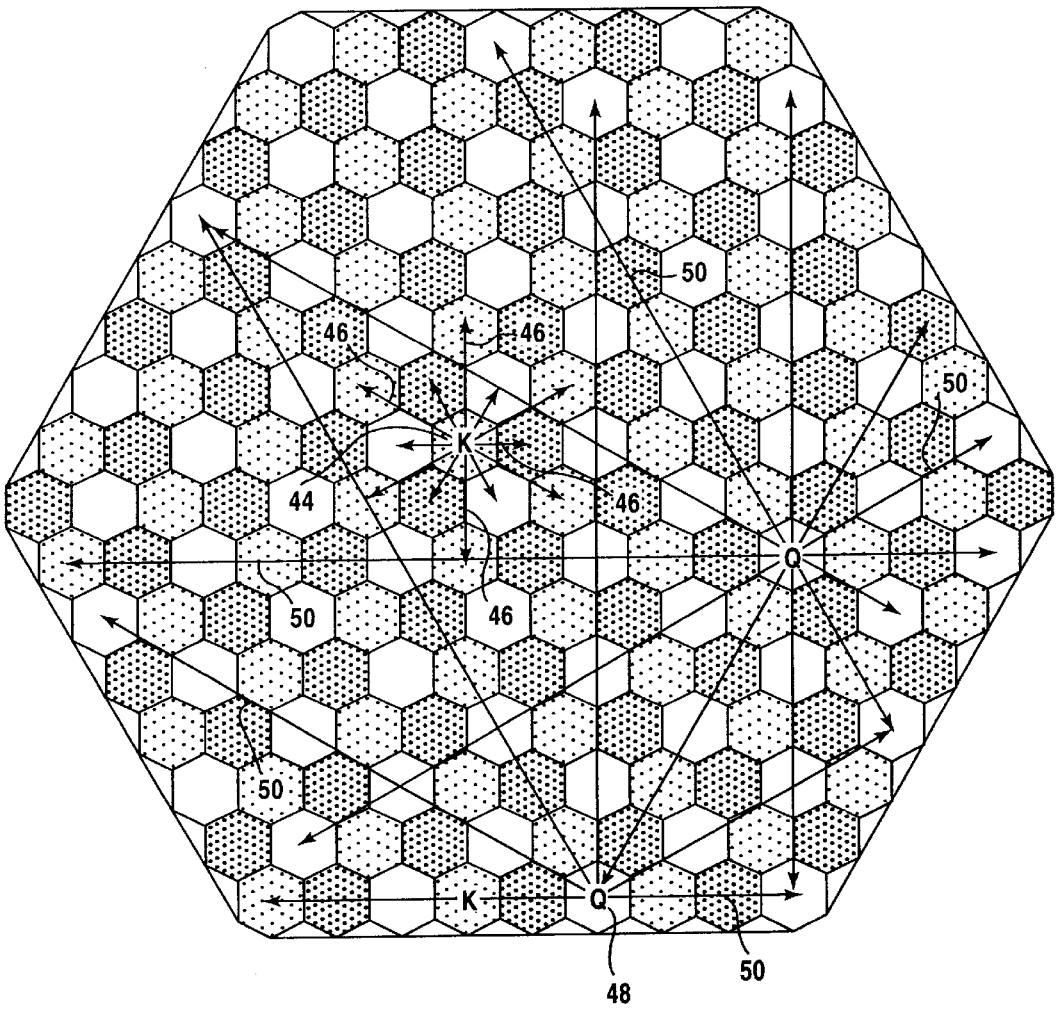
FIG. 5 is a top plan view of the chessboard showing the manner in which the King and Queen may be moved: the King one hex, either across a flat or angled hex side in any direction, and the Queen any number of spaces across either an angled or a flat hex side.
Figure 6:
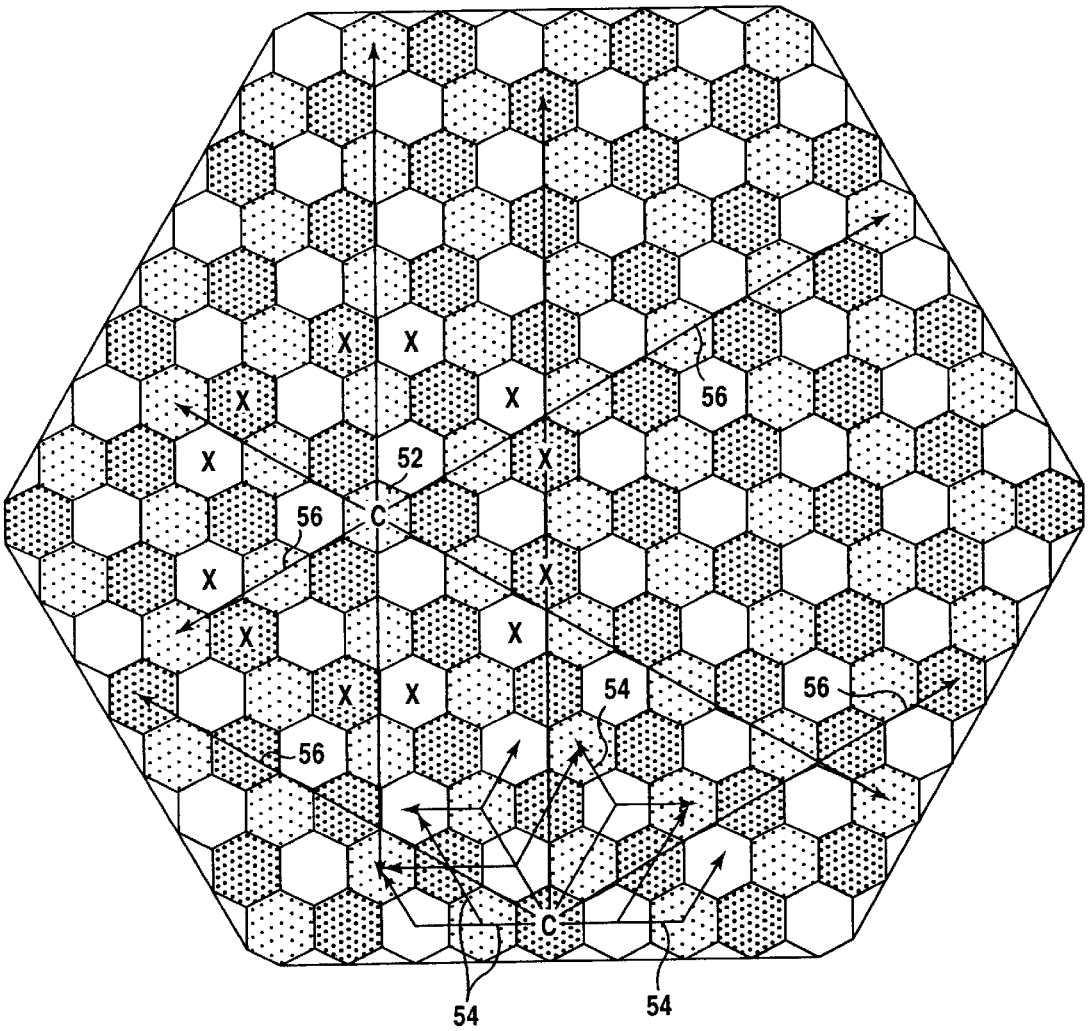
FIG. 6 shows a top plan view of the chessboard showing the manner in which the new piece in the instant invention, referred to in the preferred embodiment as the "Champion," may be moved. On any given move, it may act as a Knight or a Bishop.

In FIG. 5, the movements allowed the King 44 and Queen 48 are shown. In the King's 44 case, the piece may move one flat or one angled hex side in any direction indicated by arrows 46. As in traditional chess, the King may not be moved into check and, if in check, must be moved out of check immediately.

The Queen 48 (also in FIG. 5) moves any number of angled or flat hex sides in any direction, limited by interfering pieces of her own or an enemy side. This is shown by arrows 50.

Champion

Figure 7:
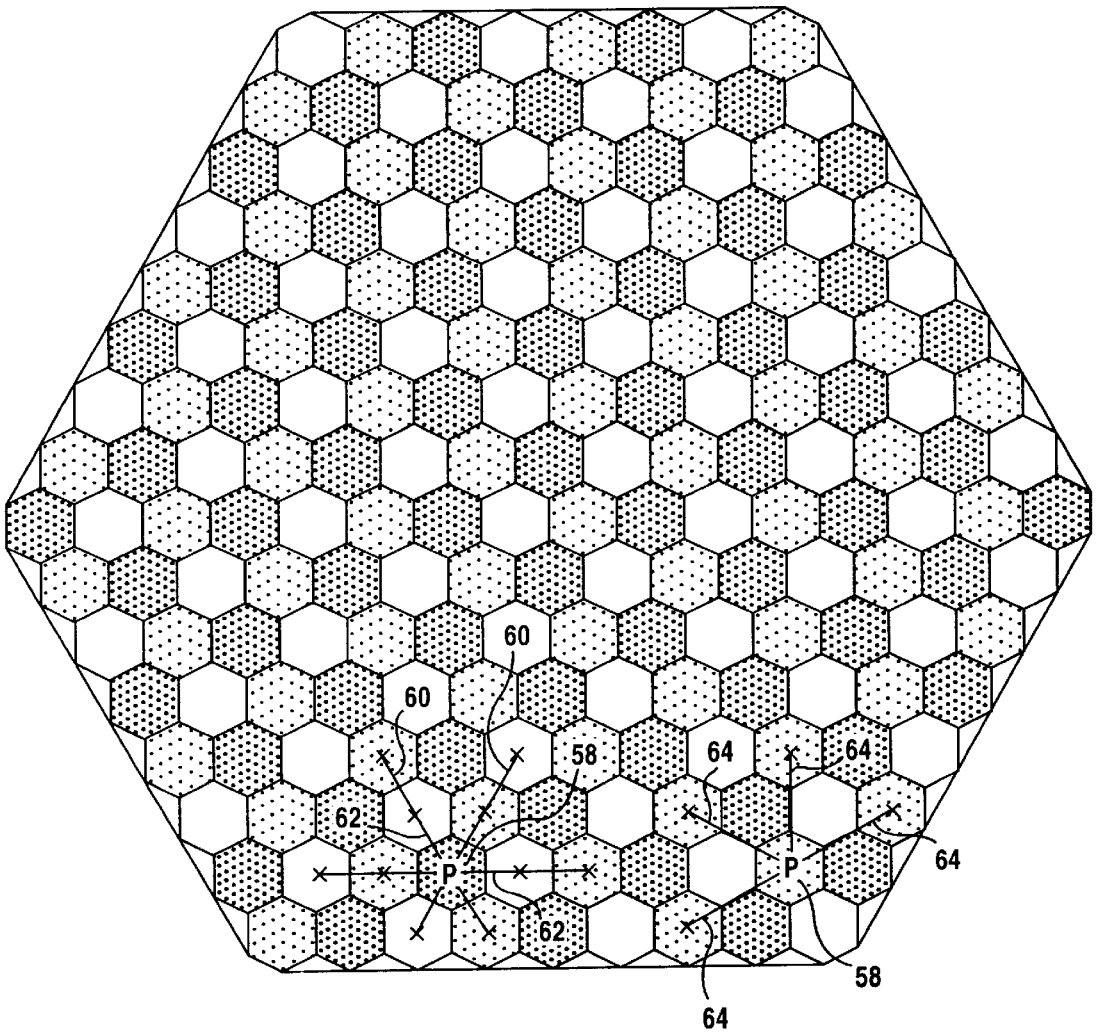
FIG. 7 shows a top plan view of the chessboard showing the manner in which the pawns may move in the game. They may move across one flat hex side, except on the initial move, where they may move across two flat hex sides. Pawns are not limited in the game to only moving in one direction. They may move in any direction across a flat hex side. Pawns capture across angled hex sides. A pawn moving two initial spaces and ending adjacent to an opposing pawn may be captured en passant.

Turning to FIG. 7, the move of the new piece introduced in this invention is described. This piece is referred to as the Champion, is enumerated at 52, and it is initially placed on the board intermediate the King and the Queen. The Champion 52 is allowed a choice of moving as a Knight or as a Bishop on any given turn. Arrows 54 and 56 show these moves, respectively. Note that through the Knight move, the Champion becomes, in effect, a Bishop of a different color from which it began. This, along with the Knight's jumping capability, makes it a formidable piece.

Pawns

In FIG. 7, the moves of the Pawns 58 are shown. Note that in the present invention, pawns are not limited to a single direction as they are in traditional chess. Pawns are allowed to move backwards, forwards, and sideways. On the initial move, they are allowed to move through two flat hex sides, as indicated at 60, and on subsequent moves, they are allowed to move through one flat hex side, as indicated at 62. Pawns capture across angled hex sides, as indicated at 64. If a pawn makes an initial first move of two flat hex sides and ends adjacent an opposing pawn, the opposing pawn may capture en passant.

Castling

Figure 8:
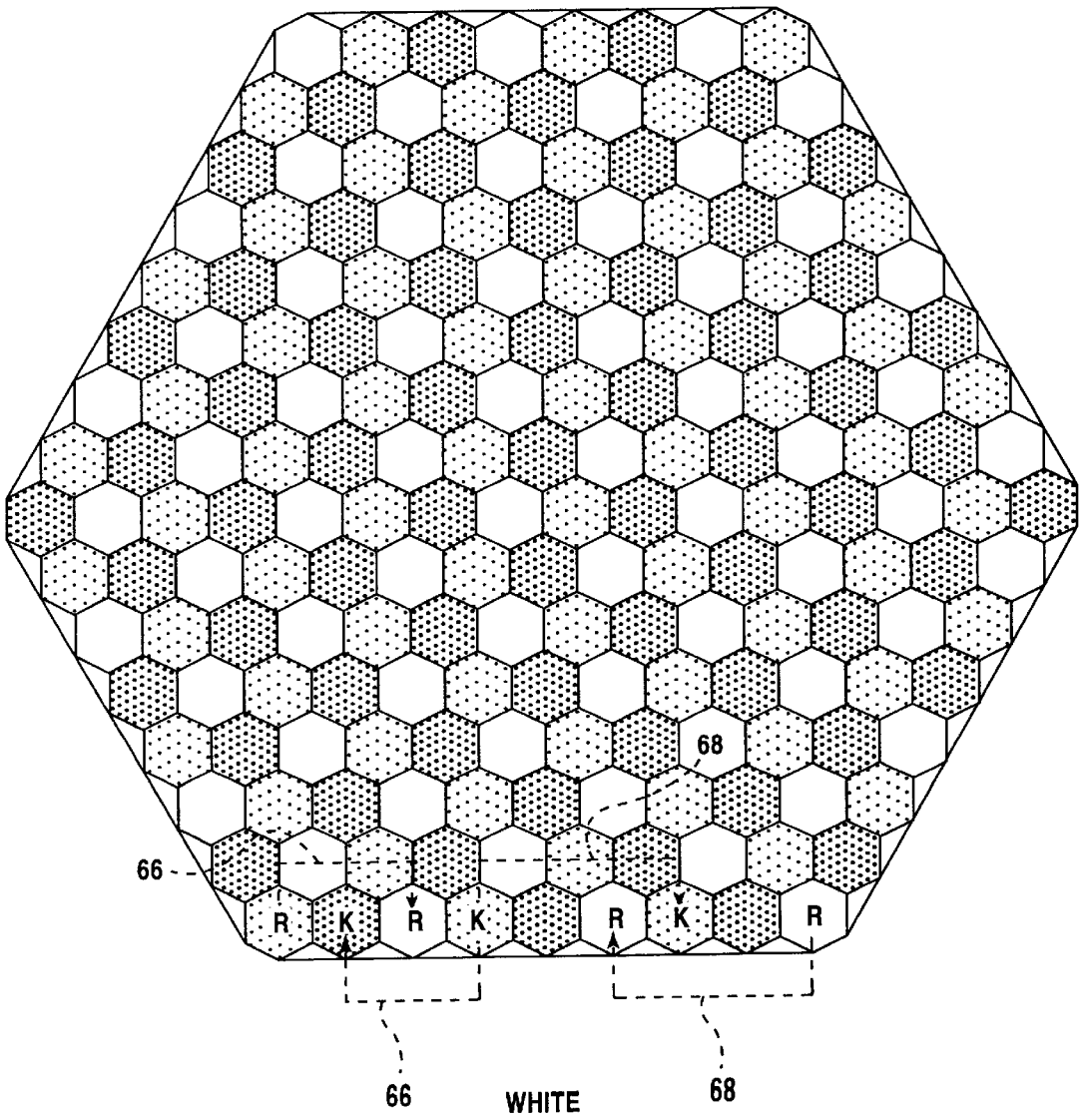
FIG. 8 shows a top plan view of the chessboard showing the manner in which a player may castle. Castling is symmetric in the present invention.

Castling in the instant invention is symmetrical on both the King and Queen side of the board. Both the King and the Rook move an equal number of spaces toward one another (two if on the K-side, three if on the Q-side) and pass through one another as indicated in FIG. 8 at 66 and 68 (K-side and Q-side, respectively). As in traditional chess the King may not castle out of check, into check, or pass through a threatened square. In the instant three player chess game castling is improved by eliminating the confusion over where the kings rests after castling on the left side, due to the fact that the board is symmetric on both the right and left sides.

Three Player Chess Notation

Figure 9:
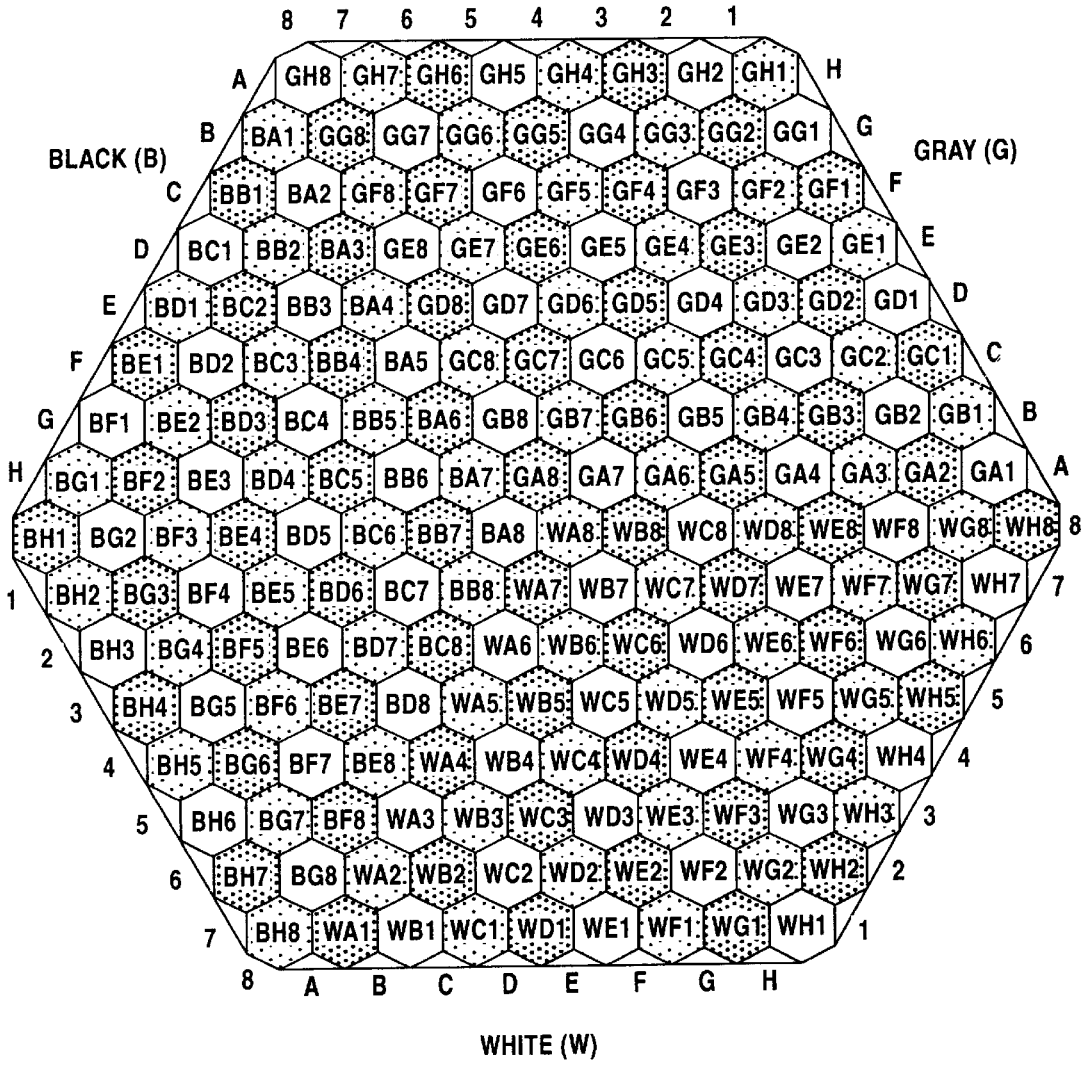
FIG. 9 shows a top plan view of the chessboard with each of the hexes labeled in a preferred notation to allow for the recording of games, if desired.

In regard to FIG. 9, note that algebraic type notation is used with a prefix indicating what color or side of the board it is directed from. Three separate sections of notation are contemplated for the recording and replaying of games. In standard two player chess which is played on a 64 square board, notation is achieved by numbering and lettering 2 adjacent board sides A–H and 1–8, permitting exact locations of all pieces to be designated. In the instant three player chess game, the notation for the 192 space board is achieved in a similar fashion by dividing the board into three groups of 64 spaces. The A–H and 1–8 notate the two adjacent sides of each of the 3 sections. Sections are differentiated by the addition of a third alpha-character designating color. For example, Black would have BH1. White would have WH1. Grey would have GH1. FIG. 9 clearly shows the positions of the hexagons with respect to their alphanumeric representations.

As mentioned earlier, the three player chess game may easily be modified to be played on an electronic device. Such a device may include a stand alone device, where players sit at a board and where a computer may play one, two or all three players. Additionally, software may be created to permit the instant game to be loaded onto a personal computer. In this version as well, the computer may play one or both of the opponents. Additionally, the instant game may be loaded onto a network or the Internet, to permit players to play against anonymous opponents who are likewise logged onto the net or the World Wide Web. A hand held version for individual play may also be provided.

The color of the playing hexes on the boards may be chosen to be any known color. The colors of ivory, jade and smoke may have a certain aesthetic appeal. Other colors, such as charcoal may also be employed. Additionally, any other known color, mixture of colors, patterns or other hex designations are considered to be included in this discussion. The playing pieces may be traditional or untraditional, this application in no way limits the appearance of any of the playing pieces.

The present invention is susceptible to variations and modifications which may be introduced without departing from the inventive concept. It is to be understood that the present invention is not limited to the embodiments described above, but encompasses any and all embodiments within the scope of the following claims.

I claim:

1. An apparatus for playing a three player game of chess comprising:

a hexagonal game board including a plurality of hexagonal playing spaces contiguously disposed thereon, said hexagonal game board including three player side edges and three adjacent side edges, one of each said player side edges being disposed opposite one of each said adjacent side edges;

said hexagonal playing spaces having three different designations, said hexagonal playing space designations being alternately arranged such that no two adjacent hexagonal playing spaces are the same; and where said hexagonal playing spaces number 192, said hexagonal playing spaces arranged along each said player side edge being nine in number, and said hexagonal playing spaces arranged along each said adjacent side edge being eight in number.

2. The apparatus according to claim 1, where said hexagonal playing space designations are chosen from the group comprising contrasting colors and different patterns.

3. The apparatus according to claim 1, wherein playing pieces are placed on two rows of said contiguous hexagonal playing spaces, said two rows being most proximal to each of said player side edges.

4. The apparatus according to claim 3, wherein said playing pieces are chess playing pieces including at least two rooks, two bishops, two knights, a king, a queen, and ten pawns.

5. The apparatus according to claim 4, wherein said playing pieces move across flat edges and angled edges of said contiguous hexagonal playing spaces as conventional chess pieces move across files or rows and diagonals, respectively.

6. The apparatus according to claim 5, further including a piece located centrally in said row of contiguous hexagonal playing spaces most proximal to each said player side edge, said piece being able to move in the manner of either a conventional chess knight or chess bishop each move, at the controlling player's wish.

7. The apparatus according to claim 6, wherein each said piece designated as a conventional chess pawn is able to move in any direction on the board, subject to conventional chess limitations on the distance that may be moved.

8. An apparatus for playing a three player game of chess comprising:

a hexagonal game board including a plurality of hexagonal playing spaces contiguously disposed thereon, said hexagonal game board including three player side edges and three adjacent side edges, one of each said player side edges being disposed opposite one of each said adjacent side edges;

said hexagonal playing spaces having three different designations, said hexagonal playing space designations being alternately arranged such that no two adjacent hexagonal playing spaces are the same;

said hexagonal playing spaces number 192, said hexagonal playing spaces arranged along each said player side edge being nine in number, and said hexagonal playing spaces arranged along each said adjacent side edge being eight in number; and where playing pieces are placed on two rows of said contiguous hexagonal playing spaces, said two rows being most proximal to each of said player side edges and said playing pieces move across flat edges and angled edges of said contiguous hexagonal playing spaces as conventional chess pieces move across files or rows and diagonals, respectively.

9. The apparatus according to claim 8, wherein said playing pieces are chess playing pieces including at least two rooks, two bishops, two knights, a king, a queen, and ten pawns.

10. The apparatus according to claim 9, further including a piece located centrally in said row of contiguous hexagonal playing spaces most proximal to each said player side edge, said piece being able to move in the manner of either a conventional chess knight or chess bishop each move, at the controlling player's wish.

11. The apparatus according to claim 10, wherein each said piece designated as a conventional chess pawn is able to move in any direction on the board, subject to conventional chess limitations on the distance that may be moved.

12. A method of playing a three person chess game comprising the steps of:

providing a hexagonal board having 192 contiguous hexagonal playing spaces disposed thereon, where said hexagonal board includes three player edges and three adjacent edges each of said player edges being opposite to one of said adjacent edges, where nine of said contiguous hexagonal playing spaces are aligned along each said player edge and where eight of said contiguous hexagonal playing spaces are aligned along each adjacent edge;

providing a plurality of pieces representing conventional chess pieces for each one player;

locating said pieces on two rows of said contiguous hexagonal playing spaces located most proximate to each of said player edges;

determining a playing order between the players;

moving said pieces sequentially in said determined order such that said pieces representing conventional chess pieces move across flat edges and angled edges of said contiguous hexagonal playing spaces as conventional chess pieces move across files or rows and diagonals, respectively.

13. The method according to claim 12, wherein said step of providing said plurality of pieces representing chess playing pieces includes providing at least two rooks, two bishops, two knights, a king, a queen, and ten pawns.

14. The method according to claim 13, wherein said step of providing said plurality of pieces further includes providing a piece located centrally in said row of contiguous hexagonal playing spaces most proximal to each said player side edge, said piece being able to move in the manner of either a conventional chess knight or chess bishop each move, at the controlling player's wish.

* * * * *